US009127488B2

(12) United States Patent
Savant et al.

(10) Patent No.: US 9,127,488 B2
(45) Date of Patent: Sep. 8, 2015

(54) METHOD FOR ASSEMBLING A HANDLE IN AN OPENABLE BODY SECTION OF AN AUTOMOBILE AND ASSOCIATED OPENABLE BODY SECTION HANDLE

(75) Inventors: Fiorenzo Savant, Pianezza (IT); Antonio Rocci, Pianezza (IT)

(73) Assignee: VALEO S.p.A., Santena TO (IL)

( * ) Notice: Subject to any disclaimer, the term of this patent is extended or adjusted under 35 U.S.C. 154(b) by 592 days.

(21) Appl. No.: 13/384,604

(22) PCT Filed: Jul. 23, 2010

(86) PCT No.: PCT/EP2010/060748

§ 371 (c)(1),
(2), (4) Date: Jan. 18, 2012

(87) PCT Pub. No.: WO2011/012555

PCT Pub. Date: Feb. 3, 2011

(65) Prior Publication Data

US 2012/0119525 A1 May 17, 2012

(30) Foreign Application Priority Data

Jul. 29, 2009 (IT) ..... MI2009A1352

(51) Int. Cl.

| | |
|---|---|
| ***E05B 3/00*** | (2006.01) |
| ***E05B 79/06*** | (2014.01) |
| ***E05B 85/16*** | (2014.01) |
| *E05B 5/00* | (2006.01) |

(52) U.S. Cl.

CPC ..... *E05B 79/06* (2013.01); *E05B 85/16* (2013.01); *Y10T 29/49963* (2015.01); *Y10T 292/57* (2015.04)

(58) Field of Classification Search

USPC ..... 292/336.3, DIG. 53, DIG. 54, DIG. 64

See application file for complete search history.

(56) References Cited

U.S. PATENT DOCUMENTS

| | | | | |
|---|---|---|---|---|
| 2,629,248 | A * | 2/1953 | Burdick | 70/370 |
| 2,633,011 | A * | 3/1953 | Poupitch | 70/370 |
| 5,297,405 | A * | 3/1994 | Manning et al. | 70/208 |

(Continued)

FOREIGN PATENT DOCUMENTS

| | | | |
|---|---|---|---|
| DE | 102 22 289 | A1 | 11/2003 |
| EP | 1 323 881 | A2 | 7/2003 |

(Continued)

OTHER PUBLICATIONS

International Search Report w/translation from PCT/EP2010/060748 dated Oct. 11, 2010 (6 pages).

*Primary Examiner* — Carlos Lugo

(74) *Attorney, Agent, or Firm* — Osha Liang LLP

(57) ABSTRACT

A method for assembling a handle of a motor vehicle includes assembling, from an outside of a panel, an articulation end of a gripping lever of a motor vehicle opening-element handle in a first cavity of articulation of the panel and a fixed positioning body in a second positioning cavity of the panel. The method also includes inserting a bolt body into the fixed positioning body from the outside of the panel, screwing a first fastening screw into the bolt body through the fixed positioning body from an inside of the panel so as to screw the bolt body directly on the panel and to fasten the fixed positioning body on the panel, and screwing a second fastening screw into the articulation end from the inside of the panel.

9 Claims, 4 Drawing Sheets

(56) References Cited

U.S. PATENT DOCUMENTS

Figure 1:
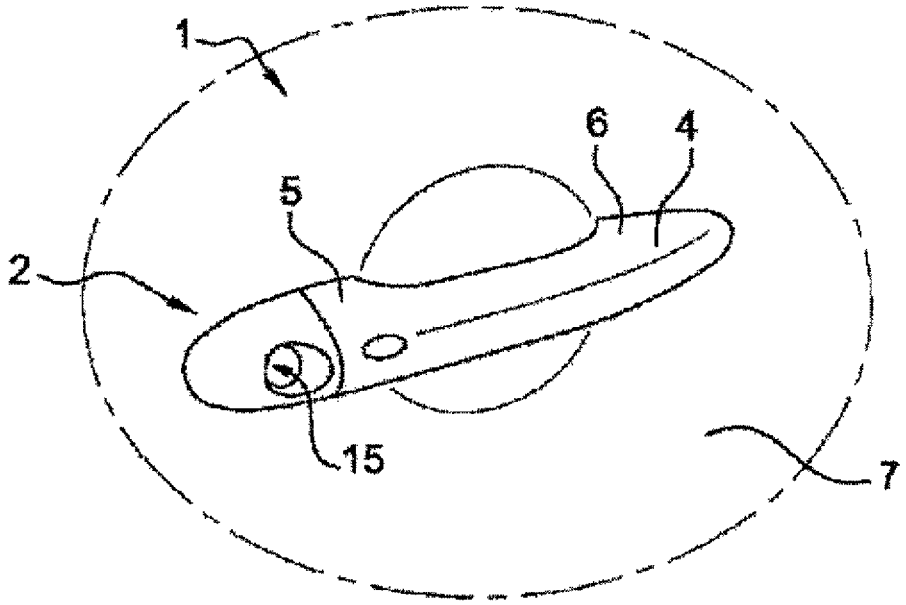

| | | | | |
|---|---|---|---|---|
| 5,421,061 | A * | 6/1995 | Kolle et al. | 292/336.3 |
| 5,987,942 | A * | 11/1999 | Ichinose | 70/208 |
| 6,378,921 | B1 * | 4/2002 | Deischl et al. | 292/336.3 |
| 6,401,302 | B1 * | 6/2002 | Josserand et al. | 16/444 |
| 6,494,066 | B2 * | 12/2002 | Muneta | 70/208 |
| 6,543,090 | B2 * | 4/2003 | Muneta | 16/412 |
| 6,588,813 | B1 * | 7/2003 | Marcarini et al. | 292/347 |
| 6,612,630 | B1 | 9/2003 | Meinke | |
| 6,719,336 | B2 * | 4/2004 | Sato | 292/336.3 |
| 6,749,236 | B2 * | 6/2004 | Nomura et al. | 292/336.3 |
| 6,765,472 | B2 * | 7/2004 | Suparschi et al. | 340/5.62 |
| 6,834,901 | B2 * | 12/2004 | Low | 296/1.02 |
| 6,910,303 | B1 * | 6/2005 | Mathofer | 49/503 |
| 7,260,964 | B2 * | 8/2007 | Velicanin et al. | 70/208 |
| 7,344,168 | B2 * | 3/2008 | Matsubara et al. | 292/336.3 |
| 7,437,803 | B2 * | 10/2008 | Watanabe et al. | 16/412 |
| 7,513,544 | B2 * | 4/2009 | Cummins et al. | 292/336.3 |
| 7,562,916 | B2 * | 7/2009 | Cummins et al. | 292/336.3 |
| 7,597,364 | B2 * | 10/2009 | Muneta | 292/80 |
| 7,971,913 | B2 * | 7/2011 | Sunahara et al. | 292/336.3 |
| 8,104,314 | B2 * | 1/2012 | Mueller et al. | 70/370 |
| 8,328,250 | B2 * | 12/2012 | Botten et al. | 292/336.3 |
| 8,459,706 | B2 * | 6/2013 | Yoshino et al. | 292/336.3 |
| 2003/0111850 | A1 | 6/2003 | Kwak | |
| 2006/0082167 | A1 | 4/2006 | Matsubara et al. | |
| 2008/0088139 | A1 * | 4/2008 | Sunahara et al. | 292/336.3 |
| 2013/0233034 | A1 * | 9/2013 | Ono et al. | 70/101 |

FOREIGN PATENT DOCUMENTS

| | | | |
|---|---|---|---|
| GB | 2415743 | B * | 6/2006 |
| WO | 2005/042883 | A1 | 5/2005 |

* cited by examiner

METHOD FOR ASSEMBLING A HANDLE IN AN OPENABLE BODY SECTION OF AN AUTOMOBILE AND ASSOCIATED OPENABLE BODY SECTION HANDLE

The present invention relates to a method for assembling a handle in a motor-vehicle opening element and to a handle operated by a gripping lever designed for motor vehicle doors.

Motor-vehicle opening-element handles are known that comprise a gripping lever that can be accessed from the outside of the vehicle and on which a user pulls outward to open the door. This lever is connected to a fixed portion, also called a handle base plate or mount which is designed to be installed inside the door, more precisely behind the external face of the door, and which is therefore not visible once installed on the vehicle.

The gripping lever and the bolt are usually assembled from the outside of the door panel with the base plate and the associated mechanism which are provided inside the door panel. Certain handles are however known in which the bolt is incorporated into the handle and which are fully assembled from the outside of the opening element.

The object of the invention is to propose a method for assembling a handle in a motor-vehicle opening element that is simplified relative to those of the prior art. A further object of the invention is to propose a corresponding motor-vehicle opening-element handle.

Accordingly, the subject of the invention is a method for assembling a handle in a motor vehicle opening-element panel, characterized in that:

during a first step, the method begins by assembling from the outside of said panel an articulation end of a gripping lever of a motor vehicle opening-element handle in a first cavity of articulation of said panel and said fixed positioning body in a second positioning cavity of said panel, and during a second step succeeding said first step, a bolt body is inserted into said fixed positioning body from the outside of said panel, a fastening screw is screwed into said bolt body through said fixed positioning body from the inside of said panel and a fastening screw is screwed into the articulation end from the inside of said panel.

It is also possible to pre-screw the fastening screw in said articulation end from the inside of said panel at the beginning of the second step, before inserting said bolt body into said fixed positioning body.

Thus, the motor-vehicle opening-element handle requires no handle base plate mounted inside the door. The lever, and the bolt body are assembled from the outside of the opening-element panel, with the bolt body assembled separately as the main step of a final assembly step.

The assembly method is therefore simplified because the main parts of the handle are assembled to the opening element from the outside of the opening element. Only the assembly of the fastening screws is carried out from the inside of the opening element.

A further subject of the invention is a motor-vehicle opening-element handle comprising:

a gripping lever, that can be rotated relative to the opening element about a rotation spindle between a rest position and a position for controlling the opening of a motor vehicle opening element, and a fixed positioning body designed to be fixed in a positioning cavity of a panel of said opening element and in which a first through-housing through which said positioning cavity emerges, is arranged to receive an appendage of said gripping lever, characterized in that a second through-housing is arranged in said fixed positioning body in order to house a bolt body designed to be inserted axially and in that said fixed positioning body also comprises means for retaining said bolt body.

Thus, the motor-vehicle opening-element handle does not require a handle base plate mounted inside the door. The handle is therefore cheaper because it requires fewer parts. Moreover, the bulk of the handle inside the opening element and the weight of the handle are reduced since there is no base plate. The space thus released can be used to place the corresponding lock behind the opening element facing the bolt outlet. Moreover, when the bolt body comprises a bolt, the connection between the bolt and the lock is made easier. The bolt may then be supplied subsequently and easily incorporated into the rest of the handle.

According to one or more features of the opening-element handle, taken alone or in combination:

said handle comprises a counterweight lever, an elastic return spring and an additional rotation spindle, said counterweight lever interacting with said gripping lever in order to pivot about said additional rotation spindle between said rest position and said control position, said elastic return spring and said counterweight lever returning said gripping lever to the rest position, said counterweight lever has a coupling tooth interacting with a corresponding housing of said appendage of the transmission lever, said fixed positioning body has a snap-fitting hook, a through-hole and a fastening screw to fasten said fixed positioning body to said panel, said positioning body comprises a sliding column fastened in said first through-housing; the sliding column makes it possible to reduce the friction with said appendage, said handle comprises a first seal designed to be placed between said opening-element panel and the fixed positioning body and a second seal placed between said opening-element panel and one articulation end of said gripping lever; the seals prevent water or dust from entering the panel through the positioning cavity, said handle comprises one or more electrical and/or electronic components, such as an electrical switch, a proximity sensor or a lighting device, housed in said gripping lever and/or in said positioning body.

Figure 2:
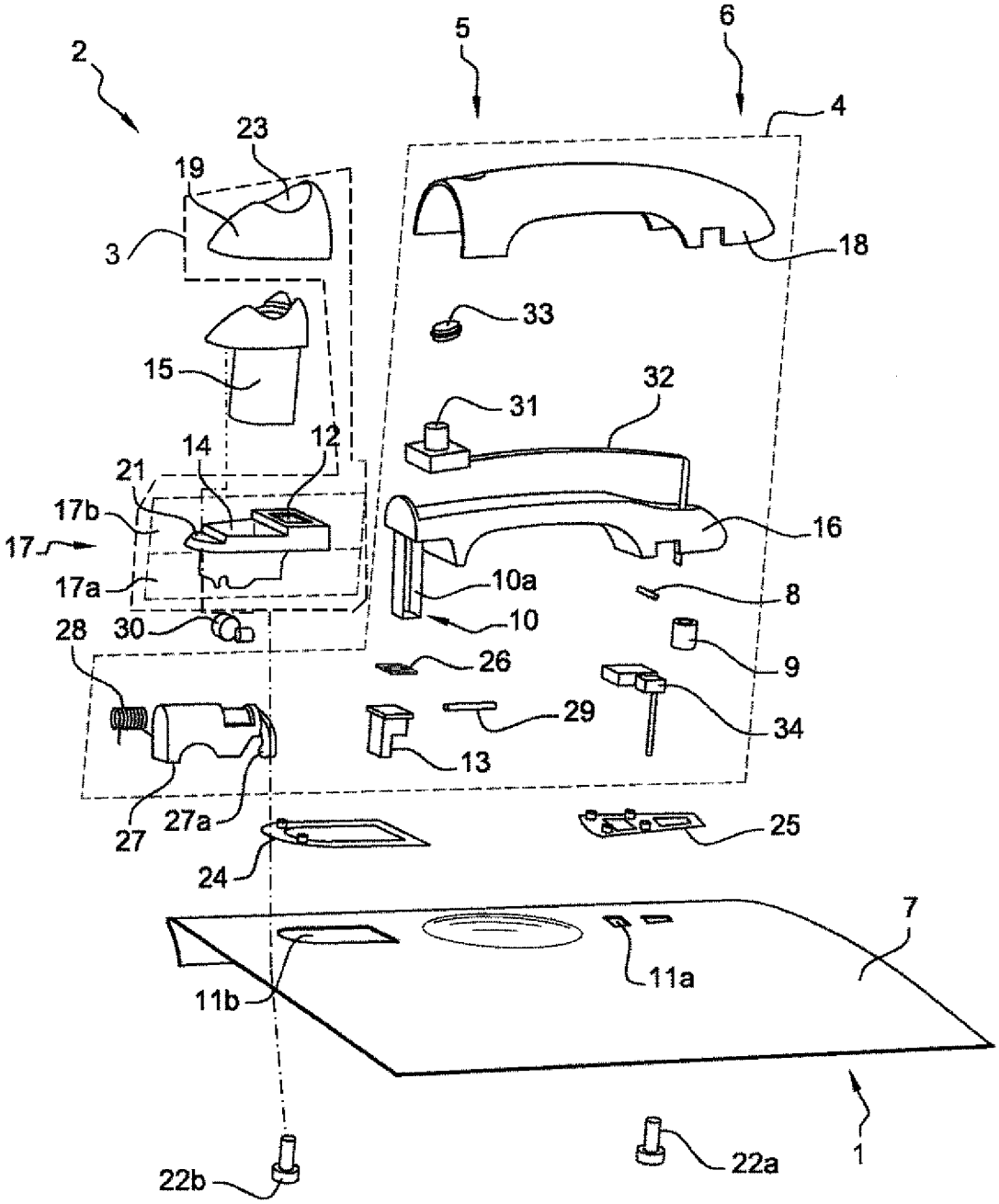
Figure 3:
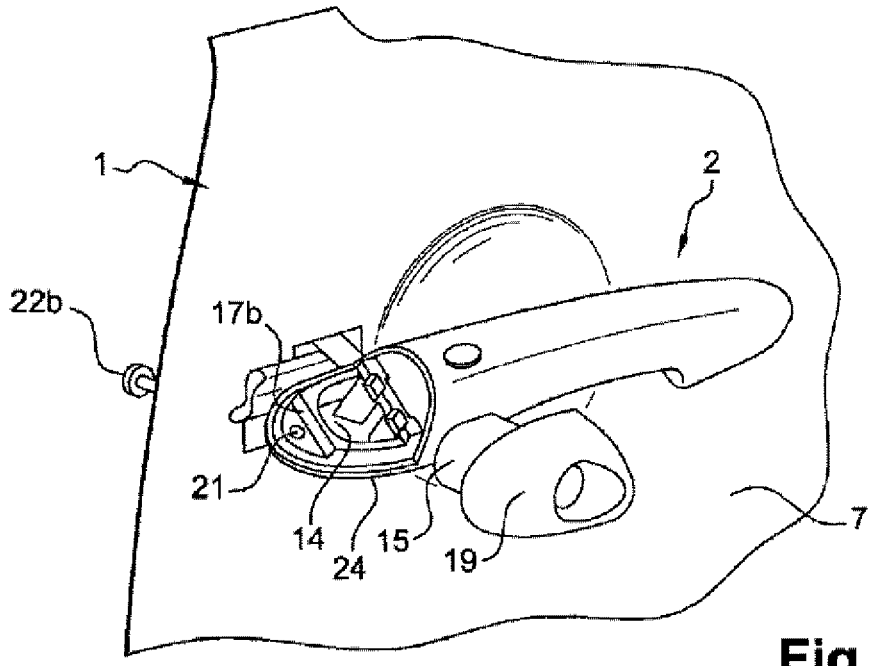
Figure 4:
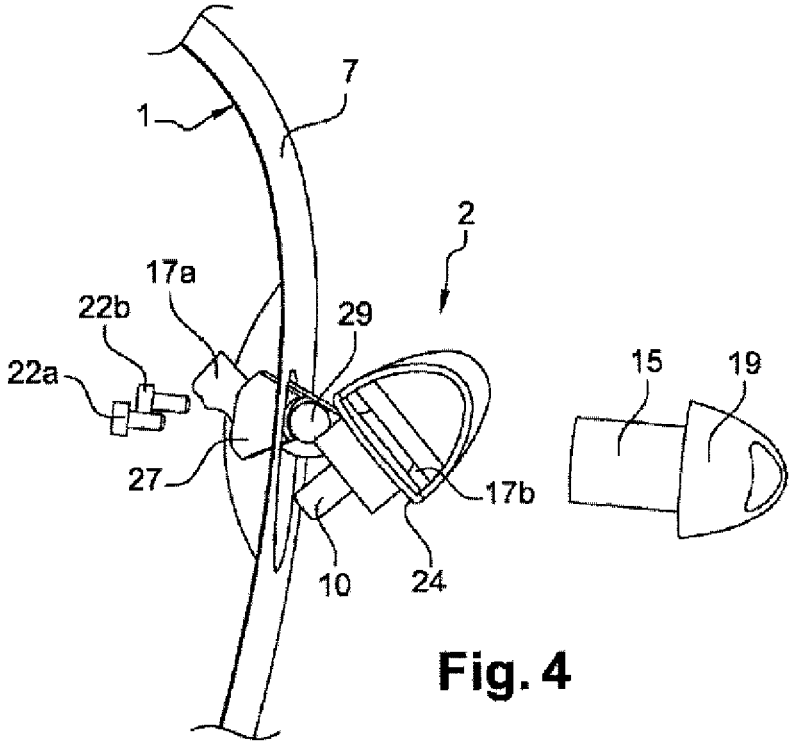
Figure 5:
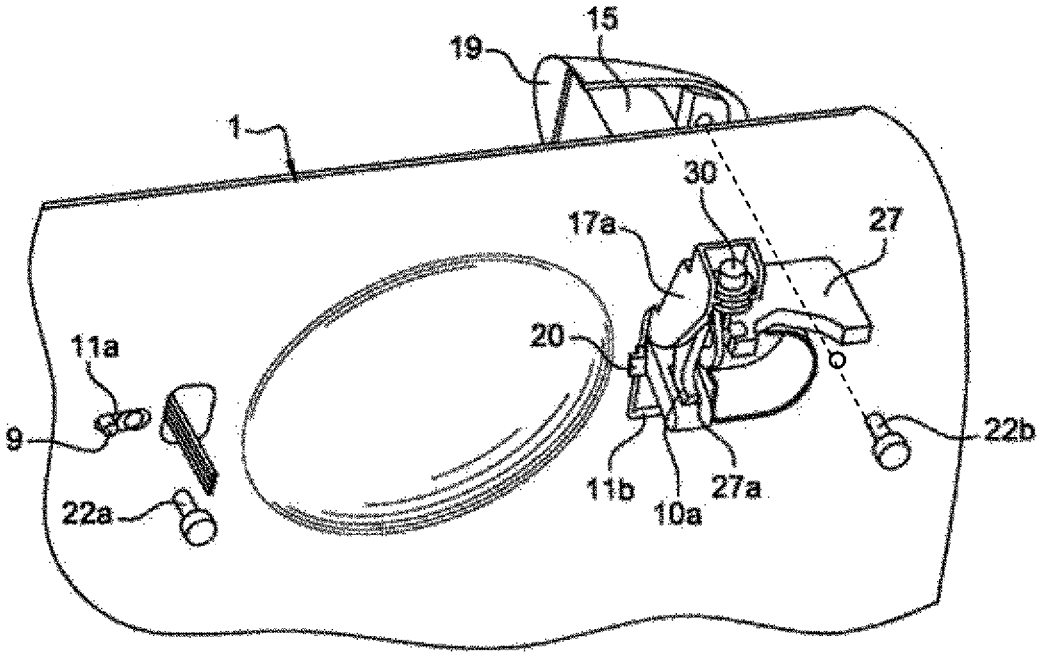
Figure 6:
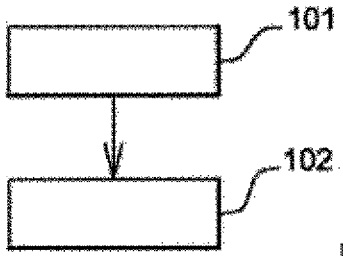

Other advantages and features will appear on reading the following description of a particular embodiment of the invention but which is in no way limiting, and the appended drawings in which:

FIG. 1 is a view in perspective from the side of a handle in the rest position assembled to a motor-vehicle opening element, FIG. 2 is a view in perspective of the handle and of the opening element of FIG. 1 in the disassembled state, FIG. 3 is a view in perspective of the handle of FIG. 1 during assembly to the opening element, seen from the outside of the opening element, FIG. 4 is a side view of FIG. 3, FIG. 5 is a rear view of FIG. 3, seen from an inside of the opening element, and FIG. 6 represents a diagram of a method for assembling the handle.

In these figures, identical elements bear the same reference numbers.

In the rest of the description, the outside is the side corresponding to the outside environment of a motor vehicle as opposed to that designating the inside of the passenger compartment when the opening element is closed.

FIGS. 1 to 5 show a motor-vehicle opening-element panel 1, such as a side door panel, and a handle 2 housed in the panel 1 in order to open the opening element.

The handle 2 is of the "Frigo" type. It comprises a fixed positioning body 3 (or "clamp") and a gripping lever 4 that is generally C-shaped and which defines the cross shaft of the handle 2.

The gripping lever 4 can rotate relative to the opening element about a rotation spindle between a rest position (FIG. 1) and a control position (not shown) for the opening of the opening element when the user pulls on this lever 4.

The gripping lever 4 comprises two opposite end portions: a pivoting end 5 and an articulation end 6.

The articulation end 6 is designed to be fastened in an articulation cavity 11*a* of the panel 1 on an outer surface 7 of the vehicle by means of a hinge articulation. The hinge articulation comprises a rotation spindle 8 assembled in a hinge 9 (see FIG. 2) for the rotation of the gripping lever 6, in operation, about the rotation spindle 8 relative to the fixed positioning body 3.

The pivoting end 5 comprises an appendage 10 for actuating an element of a lock of the motor vehicle via a flexible cable (not shown).

The fixed positioning body 3 is designed to be fastened in a positioning cavity 11*b* of the panel 1. A first through-housing 12 through which the positioning cavity 11*b* emerges is arranged in the fixed positioning body 3 in order to receive the appendage 10 of the gripping lever 4.

The fixed positioning body 3 may also comprise a sliding column 13 fastened in the first housing 12. The column 13 has a hollow shape of which the inside is adapted to receive the appendage 10. The sliding column 13 makes it possible to reduce the friction with the appendage 10; it is made for example of plastic.

A second through-housing 14 is arranged in the fixed positioning body 3 in order to house a bolt body 15 designed to be inserted axially, that is to say along the longitudinal axis of the bolt body 15. Moreover, the fixed positioning body 3 comprises means for retaining the bolt body 15.

The bolt body 15 comprises a bolt, for example when the handle 2 is designed for the opening element of the driver and does not comprise one when the handle 2 is designed for the opening element of a passenger. The bolt is for example screwed into the bolt body 15 and held by interaction of hooks. The longitudinal axis of the bolt body corresponds to the rotation axis of a bolt which would be inserted into the bolt body. The same bolt body 15 is therefore used for the handles designed for the driver and for the passengers, so that the assembly method remains identical for all the handles of the motor vehicle, with the insertion of the bolt body 15 from the outside of the opening element separately from the handle.

The bolt body 15 has for example an extension formed for being inserted axially by sliding into the second housing 14 from the outside of the opening element. The bolt body 15 is then held in the fixed positioning body 3 by retention means. The retention means comprise a fastening screw 22*b* for fastening the bolt body 15 in the fixed positioning body 3 through the panel 1.

Thus, the handle 2 requires no handle base plate mounted inside the opening element. The handle 2 is therefore cheaper because it requires fewer parts. Moreover, the bulk of the handle inside the opening element and the weight of the handle are reduced since there is no base plate. The space thus released can be used for placing the corresponding lock behind the opening element, facing the outlet of the bolt. Moreover, when the bolt body 15 comprises a bolt, the connection between the bolt and the lock is made easier. The bolt may then be supplied subsequently and easily incorporated into the rest of the handle.

When the bolt body 15 comprises a bolt, the latter is designed to be connected to a lock of the opening element (not shown) by an actuation rod connected to the bolt by a connection of cardan type so as to absorb the operating clearances between the opening element and the lock.

According to an embodiment shown in FIG. 2, the gripping lever 4 and the positioning body 3 comprise respectively respective rigid internal cores 16, 17 surmounted by protective covers 18, 19.

The internal core 17 of the fixed positioning body 3 comprises an internal portion 17*a* which extends inside the positioning cavity 11*b* of the panel 1 and an external portion 17*b* protruding from the external surface 7 of the panel.

The fixed positioning body 3, in particular the internal core 17 of the fixed positioning body 3, comprises a snap-fitting hook 20 and a through-hole 21. The through-hole 21 is for example arranged opposite the snap-fitting hook 20 in the external portion 17*b* of the internal core 17 of the fixed positioning body 3.

The snap-fitting hook 20 is designed to interact with the panel 1 in the positioning cavity 11*b*, and the through-hole 21 is disposed on the internal core 17 in order to fasten the fixed positioning body 3 to the panel 1 by means of a fastening screw 22*b* of the handle 2 that can be screwed into the panel 1 and through the through-hole 21. During assembly, the fixed positioning body 3 is inserted and snap-fitted into the positioning cavity 11*b*. The bolt body 15 is then inserted into the fixed positioning body 3 and is screwed to the panel 1 by the fastening screw 22*b* screwed from the inside of the panel 1.

The cover 19 of the fixed positioning body 3 covers the top of the bolt body 15. It may comprise a hole 23 for gaining access to the entrance of the bolt when the bolt body 15 comprises a bolt. The cover 18 of the gripping lever 4 covers the internal core 16 except for the appendage 10 and for the surface of the core 16 of the portion facing the panel 1. The covers 18, 19 may comprise different finishes: painted, rough chrome-plated, etc.

The handle 2 may comprise a first seal 24 placed between the opening-element panel 1 and the fixed positioning body 3 beneath the top portion 17*b* and a second seal 25 placed between the opening-element panel 1 and the articulation end 6 of the gripping lever 4. It is also possible to provide a column seal 26 at the external end of the sliding column 13. The seals 24, 25, 26 prevent water or dust from getting inside the panel 1 through the cavities 11*b*, 11*b* of the panel 1.

The handle 2 may comprise a counterweight lever 27, an elastic return spring 28 and an additional rotation spindle 29.

The counterweight lever 27 interacts with the gripping lever 4 in order to pivot about the additional rotation spindle 29 between the rest position and the control position. The elastic return spring 28 and the counterweight lever 27 therefore return the gripping lever 4 to the rest position.

According to the embodiment that can be seen in FIG. 5, the counterweight lever 27 has a coupling tooth 27*a* interacting with a corresponding housing 10*a* of the appendage 10 of the transmission lever 4. The sliding column 13 does not cover the side of the appendage 10 having the housing 10*a* designed to interact with the coupling tooth 27*a*.

Provision can be made for the handle 2 to comprise a damper 30, for example made of plastic, fastened to the fixed positioning body 3 and interacting with the counterweight lever 27, in order to absorb the impacts at the end of travel of the counterweight lever 27. The damper 30 is assembled to the counterweight lever 27 and to the fixed positioning body 3.

Moreover, the handle 2 may comprise one or more electrical and/or electronic components, housed in the internal core 16 of the gripping lever 4 and/or in the internal core 17 of the positioning body 3.

Thus, the handle 2 may comprise an electrical commutator, such as a button. The electrical commutator comprises a switch 31 having electrical terminals 32 designed to be connected to the electrical circuits of the vehicle. The commutator may also comprise a protective cover 33, placed on the switch 31 and accessible from the outside of the vehicle through the cover 18 in order to be actuated by a user. The commutator causes the unlocking of the opening elements provided that the user is authorized.

Moreover, the handle 2 may comprise a proximity sensor designed to operate with a hands-free entry system fitted to the vehicle (not shown). The hands-free entry system allows an authorized user of the vehicle to get into the latter without having to operate a key or remote control. The recognition device of the hands-free entry system triggers an authentication procedure for authenticating an identification member carried by the user in response to the detection by the proximity sensor of the presence of the user. After authentication of the identification member, the recognition device triggers the unlocking of one or more opening elements of the vehicle.

The handle 2 may also comprise a lighting device 34 designed to light up the handle 2.

The handle 2 may also comprise an inertial security system for preventing any untoward opening of the opening element in the event of impact (not shown in the figures).

The assembly of the handle 2 to a panel 1 of the motor-vehicle opening element is carried out like this (see FIG. 6):

during a first step 101, the method begins by assembling, from the outside of the panel 1, the articulation end 6 of the gripping lever 4 in a first articulation cavity 11*a* of the panel 1 and the fixed positioning body 3 in a second positioning cavity 11*b* of the panel 1, and during a second step 102 succeeding the first step 101, a bolt body 15 is inserted into the fixed positioning body 3 from the outside of the panel 1, the fastening screw 22*b* is screwed into the bolt body 15 through the fixed positioning body 3 from the inside of the panel 1, and the fastening screw 22*a* is screwed into the articulation end 6 from the inside of the panel 1.

It is also possible to pre-screw the fastening screw 22*a* into the articulation end 6 from the inside of the panel 1 at the beginning of the second step 102, before inserting the bolt body 15 into the fixed positioning body 3.

Thus, the motor-vehicle opening-element handle 2 requires no handle base plate mounted inside the opening element. The lever 4 and the bolt body 15 are assembled from the outside of the panel 1, with the bolt body 15 assembled separately as a main step of a final assembly step 102.

The assembly method is therefore simplified because the main parts of the handle 2 are assembled to the opening element from the outside of the opening element. Only the assembly of the fastening screws 22*a*, 22*b* is carried out from the inside of the opening element.

The invention claimed is:

1. A method for assembling a handle in a motor vehicle opening-element panel, comprising:

during a first step, assembling, from an outside of said panel, an articulation end of a gripping lever of a motor vehicle opening-element handle in a first cavity of articulation of said panel and a fixed positioning body in a second positioning cavity of said panel, said fixed positioning body comprising a cover and a core with an opening; and during a second step succeeding said first step, inserting a bolt body into said core of said fixed positioning body from the outside of said panel, screwing a first fastening screw into said bolt body through said core of said fixed positioning body from an inside of said panel so as to screw the bolt body to said core of said fixed positioning body and to fasten the core of the fixed positioning body on the panel, positioning said cover of said fixed positioning body over the bolt body, and screwing a second fastening screw into the articulation end from the inside of said panel so as to screw the articulation end of the gripping lever on the panel such that the articulation end is capable of articulating.

2. The assembly method as claimed in claim 1, wherein, at a beginning of the second step, the first fastening screw is pre-screwed to said articulation end from the inside of said panel before said bolt body is inserted into said fixed positioning body.

3. A motor vehicle opening-element handle configured to be assembled in a motor vehicle opening-element panel, the handle comprising:

a gripping lever configured to be rotated relative to the opening element panel about a rotation spindle between a rest position and a position for controlling an opening of a motor vehicle opening element;

a fixed positioning body designed to be fixed in a positioning cavity of said panel of said opening-element said fixed positioning body comprising a core having a first through-housing arranged to receive an appendage of said gripping lever;

a bolt body; and a fastening screw, wherein a second through-housing is arranged in said core of said fixed positioning body to house said bolt body, which is configured to be inserted axially, and wherein the bolt body and the core of the fixed positioning body are arranged such that the fastening screw screws the bolt body to the core and fastens the fixed positioning body on the panel.

4. The handle as claimed in claim 3, further comprising:

a counterweight lever;

an elastic return spring; and an additional rotation spindle, said counterweight lever interacting with said gripping lever to pivot about said additional rotation spindle between said rest position and said control position, said elastic return spring and said counterweight lever returning said gripping lever to the rest position.

5. The handle as claimed in claim 4, wherein said counterweight lever comprises a coupling tooth interacting with a corresponding housing of said appendage of the transmission lever.

6. The handle as claimed in claim 3, wherein said fixed positioning body comprises a snap-fitting hook, and a through-hole.

7. The handle as claimed in claim 3, wherein said positioning body comprises a sliding column fastened in said first through-housing.

8. The handle as claimed in claim 3, further comprising a first seal placed between said opening-element panel and the fixed positioning body and a second seal placed between said opening-element panel and one articulation end of said gripping lever.

9. The handle as claimed in claim 3, further comprising at least one component selected from a group consisting of an electrical switch, a proximity sensor, and a lighting device, the at least one component housed in said gripping lever in said positioning body.

* * * * *